United States Patent [19]

Klingen

[11] Patent Number: 5,066,518

[45] Date of Patent: Nov. 19, 1991

[54] METHOD AND APPARATUS FOR PRESERVING CAVITY SPACES

[75] Inventor: Willy Klingen, Markdorf, Fed. Rep. of Germany

[73] Assignee: J. Wagner GmbH, Fed. Rep. of Germany

[21] Appl. No.: 490,840

[22] Filed: Mar. 6, 1990

[30] Foreign Application Priority Data

Mar. 29, 1989 [DE] Fed. Rep. of Germany ..... 3910179

[51] Int. Cl.[5] ..... B05D 7/22; B05B 7/16; B05B 13/06

[52] U.S. Cl. ..... 427/236; 118/302; 118/317; 427/239; 427/327; 427/422

[58] Field of Search ..... 427/239, 327, 236, 422; 118/317, 302

[56] References Cited

U.S. PATENT DOCUMENTS

| | | | |
|---|---|---|---|
| 3,488,213 | 1/1970 | Bellato | 427/236 |
| 4,108,382 | 8/1978 | Ryd et al. | 427/236 |
| 4,263,338 | 4/1981 | Rentmeester et al. | 427/236 |
| 4,374,871 | 2/1983 | Steinbis | 427/236 |
| 4,421,790 | 12/1983 | Nagata et al. | 427/236 |

*Primary Examiner*—Janyce Bell

*Attorney, Agent, or Firm*—Hill, Van Santen, Steadman & Simpson

[57] ABSTRACT

A method for preserving cavity spaces, particularly in an automobile chassis, is provided wherein wax is applied onto the inside walls of the cavity space to be preserved, being applied with application nozzles. The wax is heated and the heated and liquified wax is supplied under pressure to a pre-atomizer nozzle and is atomized by the latter. At the same time, compressed air is heated and is mixed in its heated condition to the jet of wax drops emerging from the pre-atomizer nozzle and relaxed. Finally, the hot mixture of wax drops and air is supplied to the application nozzle and the latter sprays it onto the walls of the cavity space to be preserved. An apparatus for the implementation of this method is composed of a heatable delivery line for the hot and liquified wax, of a pre-atomizer nozzle having a following discharge tube, of a compressed air delivery line having an air heater and of a nozzle tube having application nozzle apertures.

17 Claims, 1 Drawing Sheet

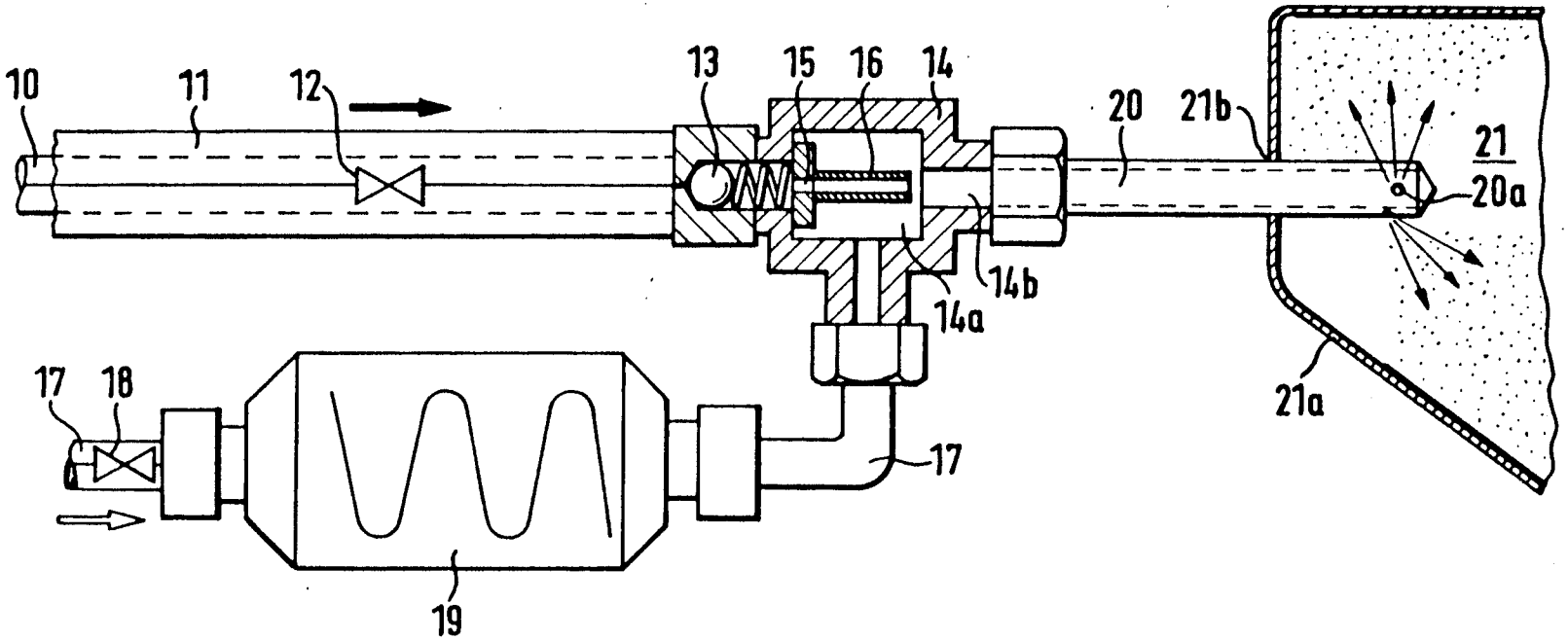
21
20a
21a
21b
20
14b
14a
14
16
15
13
17
12
11
10
19
18
17

METHOD AND APPARATUS FOR PRESERVING CAVITY SPACES

BACKGROUND OF THE INVENTION

The invention is directed to a method for preserving cavity spaces, particularly in an automobile chassis, whereby wax is applied to the inside walls of the cavity space to be preserved, being applied with application nozzles. The invention is also directed to an apparatus for the implementation of such a method.

Two methods are presently employed in treating cavity spaces of an automobile chassis, namely, the spray method utilized by several automobile manufacturers and the flooding method disclosed, for example, in DE-AS 27 55 947.

In the spray method, wax is liquified with a solvent and the liquid wax-solvent mixture is then supplied to spray nozzles from which it is then sprayed onto the inside walls of the cavity space to be preserved upon employment of compressed air (compressed air spraying method). A comparatively high air pressure is required in order to be able to spray this solvent-wax mixture, this frequently leading to what is referred to as an overspray and, moreover, a dripping from the aeration openings of the cavity space arises after the spraying process. Further, waxes that contain solvents require a relatively long curing time and involved arrangements must be undertaken in order to keep the environmental pollution due to escaping solvent as low as possible. In the flooding wax method wherein the cavity spaces are cast out with solvent-free wax that is liquified by heating, the problems of overspray and environmental pollution are in fact avoided, but the dripping involving an increased materials consumption cannot be prevented here either because a high excess of material must be employed when flooding, this excess material then simply dripping off.

Over and above this, the apparatus for the wax-flooding process are involved, expensive and require much space.

SUMMARY OF THE INVENTION

It is therefore an object of the present invention to provide a method for wax-preservation of cavity spaces, particularly in an automobile chassis, that manages with optimally little material, does not pollute the environment and nonetheless guarantees a fast and faultless preservation of cavity spaces. An apparatus for the implementation of such a method that is structurally simple, cost-saving and space-saving is also an object of the invention.

Such objects are achieved by a method for preserving cavity spaces, particularly at an automobile chassis, whereby wax is applied to inside walls of the cavity space to be preserved with application nozzles, comprising the steps: heating wax to a temperature to liquify the wax between 80° and 140° C.; supplying the heated and liquified wax to a pre-atomizer nozzle under a pressure between 40 and 150 bar to atomize the wax in the form of a jet of wax drops by the pre-atomizer nozzle; heating compressed air having a pressure between 0.5 and 5 bar to a temperature between 90° and 160° C.; mixing the compressed air in its heated condition with the jet of wax drops that has emerged from the pre-atomizer nozzle; supplying the hot mixture of wax drops and air to the application nozzle; and spraying the hot mixture of wax drops and air onto the walls of the cavity space to be preserved.

Such objects are further achieved by an apparatus for the implementation of the method described comprising a heatable delivery tube for hot, liquid preserving wax that discharges into a pre-atomizer nozzle having a following discharge tube, a compressed air delivery line having an air heater, a nozzle receptacle member in whose interior the pre-atomizer nozzle and the discharge tube are situated and into which the compressed air delivery tube discharges, and a nozzle tube having application nozzle apertures that departs from the interior of the nozzle receptacle member.

Stated succinctly, the invention involves a hot-spraying method that manages with comparatively low air pressure and without any and all solvent, such that a spraying that is exactly metered in terms of quantity is provided without environmental pollution.

BRIEF DESCRIPTION OF THE DRAWING

The invention shall be set forth in greater detail below with reference to the drawing, whereby the sole FIG. shows a schematic illustration of the apparatus of the invention.

DETAILED DESCRIPTION OF THE PREFERRED EMBODIMENT

In the figure a wax delivery tube 10 is illustrated that supplies hot, liquid wax from a wax heater (not shown). The tube 10 is surrounded by a heat insulating jacket 11. A secondary heating, for instance, in the form of electrical heating wires, is preferably provided in the insulating jacket 11 or in the delivery tube 10 itself, this secondary heating ensuring that the wax maintains its temperature. An externally controllable on/off valve 12 is provided within the secondary heating in the tube 10. Upon interposition of a check valve 13, the tube 10 discharges into a nozzle receptacle member 14, whereby a pre-atomizer nozzle 15 is inserted into the orifice. The pre-atomizer nozzle 15 is preferably fashioned such and of such a material familiar to a person skilled in the art from high-pressure or, respectively, high-pressure compressed air atomization processes of lacquering. The reason for this is that the hot wax, as shall be set forth later, is supplied with a pressure that is comparable to the paint pressure in compressed air atomization processes of lacquering. The pre-atomizer nozzle 15 is preceded by an exit tube 16 that, however, likewise still discharges within the interior **14*a* of the nozzle receptacle member 14. A compressed air line 17 coming from a compressed air source (not shown) also discharges into this nozzle interior 14*a*, an externally controllable on/off valve 18 as well as an air heater 19 being inserted into the compressed line 17. A discharge 14*b* departs from the interior 14*a*, this discharge 14*b* being in communication with a nozzle tube 20 screwed onto the nozzle receptacle member 14 that includes application nozzle apertures 20*a* at its front end. A cavity space to be preserved is indicated at 21 whose wall 21*a* has a plug-in opening 21*b* for the nozzle tube 20**.

The apparatus operates in the following way. Solid preserving wax, such as Pfinder Chemie Flutwachs AP85, produced by Pfinder Chemie in Germany, is heated to a temperature between 80° and 140° C., preferably to 120° C., in a heating furnace and the liquified wax is placed under a pressure between 40 and 150 bar, preferably at 100 bar. The liquid, hot wax is then adjacent to the closed valve 12 under this pressure, whereby the insulating jacket 11 and the secondary heating assure that the desired temperature is maintained. Compressed air is supplied via the delivery tube 17, this compressed air pending at the closed valve 18 under a pressure between 0.5 and 5 bar, preferably at 3 bar. When the valve 18 is opened, then the compressed air flows through the heater 19 in which it is heated to a temperature between 90° and 160° C., preferably to 140° C. The hot compressed air then flows into the interior 14*a* of the nozzle receptacle member 14 and flows farther into the nozzle tube 20 which it departs through the nozzle apertures 20*a*. The hot compressed air heats the interior 14*a* of the nozzle receptacle member 14 that, over and above this, is also heat insulated, and also heats the interior of the tube 20. When the front end of the nozzle tube 20 is already in the cavity space 21 to be preserved, then the cavity space 21 is also heated. The valve 12 is then opened for the preservation process, so that the hot wax flows into the nozzle receptacle member 14 where it is atomized by the pre-atomizer nozzle 15 and flows through the exit tube 16 in its atomized condition. A relaxation or decompression and retardation of the spray jet ensues in the discharge tube 16, whereby the compressed air flowing around the discharge tube 16 generates an injector effect at the orifice thereof and thus promotes the conveying of the drops of hot wax through the nozzle tube 20; particularly after emerging from the nozzle apertures 20*a*, the hot air serves as energy carrier for the uniform transport of the drops of hot wax onto the walls 21*a* of the cavity space 21.

It is of critical significance that the hot wax is not subjected to any cooling before it reaches the wall 21*a* of the cavity space 21. A number of factors contribute to this, namely, the insulation of the delivery tube 10 and the secondary heating thereof, the insulation of the nozzle receptacle member 14 and, potentially, an insulation of at least the back part of the nozzle tube 20, the heated compressed air and the pre-heating of the interior 14*a* as well as of the cavity space 21 by the hot air that is already supplied before the wax application. It is thereby especially expedient when, as known from wax flooding processes, the walls 21*a* of the cavity space 21 are pre-heated, for example, by radiators. A temperature of the walls 21*a* from 60° through 80° C., preferably 70° C., has thereby proven expedient within the framework of the invention.

As mentioned, the control of the valves should ensue such that the valve 18 is already opened for a specific time span before the valve 12 is opened because it is thus best assured that the drops of wax maintain their temperature. In standard conveyor belt preservation of an automobile chassis, one can proceed such that the valve 18 is continuously open when the conveyor belt is running, in contrast whereto the valve 12 is opened only for what are referred to as the "wax shots". It is thus also assured that wax situated in the nozzle tube 20 after the "shot" cannot adhere to the tube walls and harden there. The radiators for heating the chassis should be situated at a location of the conveyor belt preceding the waxing station.

The described apparatus can be subject to numerous modifications without departing the scope of the invention. What is critical is that the wax is heated to a temperature required for the atomization thereof and is held at this temperature by the hot compressed air until it deposits on the hot sheet metal of the chassis.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

I claim:

1. A method for preserving cavity spaces, whereby wax is applied to inside walls of the cavity space to be preserved with application nozzles, comprising the steps:

heating wax to a temperature to liquify the wax between 80° and 140° C.;

supplying the heated and liquified wax to a pre-atomizer nozzle under a pressure between 40 and 150 bar to atomize the wax in the form of a jet of wax drops by said pre-atomizer nozzle;

heating compressed air having a pressure between 0.5 and 5 bar to a temperature between 90° and 160° C.;

mixing said compressed air in its heated condition with the jet of wax drops that has emerged from the pre-atomizer nozzle;

supplying the hot mixture of wax drops and air to the application nozzle; and spraying the hot mixture of wax drops and air onto the walls of the cavity space to be preserved.

2. A method according to claim 1, including the step of pre-heating the walls of the cavity space.

3. A method according to claim 1, wherein the step of heating the wax comprises heating it to about 120° C., wherein the step of heating the compressed air comprises heating it to about 140° C. and wherein the step of heating the walls of the cavity space comprises heating them to about 70° C.

4. A method according to claim 1, comprising the further steps of supplying the heated compressed air outside of the wax-spraying periods through the application nozzles.

5. An apparatus for applying preserving wax to inside walls of cavity spaces to be preserved comprising a heatable delivery tube for hot, liquid preserving wax that discharges into a pre-atomizer nozzle for atomizing said wax and having a following discharge tube, a compressed air delivery line having an air heater, a nozzle receptacle member in whose interior the pre-atomizer nozzle and the discharge tube are situated and into which the compressed air delivery tube discharges, and a nozzle tube having application nozzle apertures that departs from the interior of the nozzle receptacle member.

6. An apparatus according to claim 5, wherein the wax delivery tube, the nozzle receptacle member, the compressed air delivery tube and the nozzle tube are at least partially heat-insulated.

7. An apparatus according to claim 5, wherein the pre-atomizer nozzle is a high-pressure nozzle.

8. An apparatus according to claim 5, wherein respective, externally controllable valves are inserted into the wax delivery tube within its heatable region and into the compressed air delivery tube preceding the heater.

9. An apparatus for applying preserving wax to inside walls of cavity spaces to be preserved comprising:

means for heating wax to a temperature to liquify the wax between 80° and 140° C.;

means for supplying the heated and liquified wax to a pre-atomizer nozzle under a pressure between 40 and 150 bar to atomize the wax in the form of a jet of wax drops by said pre-atomizer nozzle;

means for heating compressed air having a pressure between 0.5 and 5 bar to a temperature between 90° and 160° C.;

means for mixing said compressed air in its heated condition with the jet of wax drops that has emerged from the pre-atomizer nozzle;

means for supplying the hot mixture of wax drops and air to the application nozzle; and means for spraying the hot mixture of wax drops and air onto the walls of the cavity space to be preserved.

10. An apparatus for applying preserving wax according to claim 1, further comprising means for preheating said walls of said cavity spaces.

11. An apparatus according to claim 9, wherein said means for supplying the heated and liquified wax comprises a heatable delivery tube for hot, liquid preserving wax that discharges into said pre-atomizer nozzle having a following discharge tube.

12. An apparatus according to claim 9, wherein said means for heating compressed air comprises a compressed air delivery line having an air heater.

13. An apparatus according to claim 9, wherein said means for mixing said compressed air in its heated condition with the jet of wax drops that has emerged from the pre-atomizer nozzle comprises a nozzle receptacle member in whose interior the pre-atomizer nozzle is situated and into which the compressed air discharges.

14. An apparatus according to claim 13, wherein said means for spraying the hot mixture of wax drops and air onto the walls of the cavity space to be preserved comprises a nozzle tube having application nozzle apertures that departs from the interior of the nozzle receptacle member.

15. An apparatus according to claim 11, wherein the wax delivery tube is at least partially heat-insulated.

16. An apparatus according to claim 13, wherein the nozzle receptacle member is at least partially heat-insulated.

17. An apparatus according to claim 9, wherein the preatomizer nozzle is a high-pressure nozzle.

* * * * *